US009225070B1

(12) United States Patent
Zeweri et al.

(10) Patent No.: US 9,225,070 B1
(45) Date of Patent: Dec. 29, 2015

(54) CAVITY BACKED APERTURE COUPLED DIELECTRICALLY LOADED WAVEGUIDE RADIATING ELEMENT WITH EVEN MODE EXCITATION AND WIDE ANGLE IMPEDANCE MATCHING

(71) Applicant: Lockheed Martin Corporation, Bethesda, MD (US)

(72) Inventors: Mirwais Zeweri, Mount Laurel, NJ (US); Chih-Chen Hsu, Cherry Hill, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 415 days.

(21) Appl. No.: 13/632,704

(22) Filed: Oct. 1, 2012

(51) Int. Cl.
*H01Q 13/10* (2006.01)
*H01Q 13/18* (2006.01)

(52) U.S. Cl.
CPC ..... *H01Q 13/18* (2013.01)

(58) Field of Classification Search
USPC ..... 343/771
See application file for complete search history.

(56) References Cited

U.S. PATENT DOCUMENTS

| | | | | | |
|---|---|---|---|---|---|
| 3,604,009 | A * | 9/1971 | Behnke | 343/754 |
| 3,778,838 | A * | 12/1973 | Clavin | 343/727 |
| 3,946,396 | A * | 3/1976 | Smith et al. | 342/386 |
| 4,916,457 | A * | 4/1990 | Foy et al. | 343/770 |
| 5,977,710 | A * | 11/1999 | Kuramoto et al. | 343/700 MS |
| 7,289,079 | B2 | 10/2007 | Rupp et al. | |
| 7,498,989 | B1 * | 3/2009 | Volman | 343/700 MS |
| 2009/0303145 | A1 * | 12/2009 | Shijo et al. | 343/767 |

OTHER PUBLICATIONS

"Antenna Theory: A Review," Balanis, Proc. IEEE vol. 80 No. 1 Jan. 1992.*

* cited by examiner

*Primary Examiner* — Graham Smith
(74) *Attorney, Agent, or Firm* — Howard IP Law Group, PC

(57) ABSTRACT

A radiating element for a radar array antenna is provided. The radiating element comprises a first dielectric layer including a circular waveguide arranged therein, a second dielectric layer having a feed element for the circular waveguide embedded therein, and a cross-slot aperture formed in a groundplane arranged generally between the first and second dielectric layers. The feed element may comprise first and second stripline traces for exciting each of a first and second slot defining the cross-slot aperture. Each of the first and second dielectric layers comprises layers of a laminated printed wire board arrangement.

20 Claims, 6 Drawing Sheets

CAVITY BACKED APERTURE COUPLED DIELECTRICALLY LOADED WAVEGUIDE RADIATING ELEMENT WITH EVEN MODE EXCITATION AND WIDE ANGLE IMPEDANCE MATCHING

FIELD OF THE INVENTION

The present invention relates generally to radar systems, and more particularly to radiating elements used in phased array radar antennas.

BACKGROUND

Radar systems are important to the operation of various civilian and government organizations. Such organizations utilize these systems for various applications, including aircraft tracking, space object tracking (e.g. low-earth orbit), weather observation, meteorological research, unmanned aircraft systems surveillance and surface transportation.

Modern digital phased array radar systems include phased array antennas having numerous radiating elements each having a phase shifter. Beams are formed by selectively activating all or a portion of antenna elements of a given array. Scanning or steering of the beams is accomplished by shifting the phase of the signals emitted from the elements in order to provide constructive and/or destructive interference. The ability to form and steer a radar beam permits multiple functions to be performed by the same radar system. In addition to multi-function operation, these arrays tend to have a faster response time and operate at a higher resolution than existing rotating radar systems.

Modern phased array radar systems have been developed which transmit alternating or simultaneous pulses of horizontally and vertically polarized signals using, for example, arrays possessing orthogonally polarized radiating antenna elements. The orthogonal polarizations may also be used to create circularly polarized beams. As will be understood by one of ordinary skill in the art, a circularly polarized beam may be generated by creating a 90° phase shift between two orthogonal polarizations. These dual-pol radar systems, or "polarimetric" systems, offer several advantages over conventional single-pol radars. For example, in weather radar applications, by measuring along two axes, these systems have the capability of discriminating between hail and rain, estimating rainfall volume and detecting mixed precipitation.

Achieving sufficient performance (e.g. wide scan angles), high reliability and low fabrication costs in these polarimetric systems have proven difficult. Referring generally to FIGS. 1A and 1B, an exemplary polarimetric radiating element 10 according to the prior art is shown. Radiating element 10 includes a feed arrangement consisting of two pairs of vertical probes 13 embedded in a dielectric resonator configured as a puck 12 of dielectric material (e.g. ceramic). Probes 13 generate RF beams by capacitively exciting a first disk 14 arranged on a top surface of dielectric puck 12. Disk 14 in turn excites a parasitic second disk 15, which may be supported by a rod 18 extending through dielectric puck 12 and into a portion of an aluminum housing 17. Probes 13 are fed by stripline traces for generating the two orthogonal polarizations. As presently implemented, this feed arrangement utilizes circuits, such as Wilkinson combiners with embedded (i.e. buried) resistors 16 arranged in a laminated printed wire board (PWB) stack 19.

This arrangement has several drawbacks. For example, the use of buried resistors generates significant heat during operation, decreasing reliability and requiring complex thermal management considerations. In the illustrated example, housing 17 supporting dielectric puck 14 must be used as a coldplate, cooling embedded resistors 16 through conductive contact between the backside of resistors 16 and housing 17. Further, the functional accuracy of the element is dependent on the ability to precisely locate feed probes 13 within dielectric puck 12, so as to achieve a desired orientation with respect to disk 14. This alignment process can lead to further increased production costs.

Alternative structures and techniques are desired.

SUMMARY

According to one embodiment of the present disclosure, a radiating element for a radar array antenna is provided. The radiating element comprises a first dielectric layer having a circular waveguide arranged therein, a second dielectric layer including a feed element for the circular waveguide arranged therein, and a cross-slot aperture formed in a groundplane arranged generally between the first and second dielectric layers. The feed element may comprise first and second stripline traces embedded in the second dielectric layer for exciting each of a first and second slot of the cross-slot aperture. In one exemplary embodiment, each of the first and second dielectric layers may comprise layers of a laminated PWB stack.

In another embodiment of the present disclosure, a radar antenna array having a plurality of radiating elements is provided. The array includes a first dielectric layer in which a plurality of circular waveguides are formed, and a second dielectric layer in which a plurality of feed elements are arranged for exciting each of the plurality of circular waveguides. A groundplane is positioned between the first dielectric layer and the second dielectric layer, and defines a plurality of cross-slot apertures. Each cross-slot aperture is associated with a respective one of the plurality of circular waveguides. The first and second dielectric layers may form all or part of a laminated PWB arrangement.

DETAILED DESCRIPTION

Figure 1A:
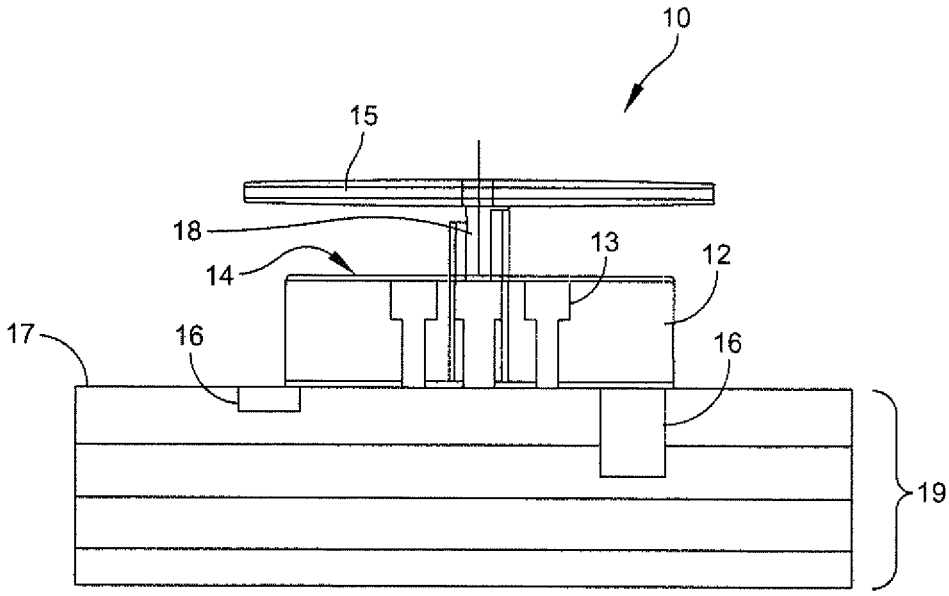
FIG. 1A (PRIOR ART)
FIG. 1A is a cross-sectional view of a radiating element according to the prior art.
Figure 1B:
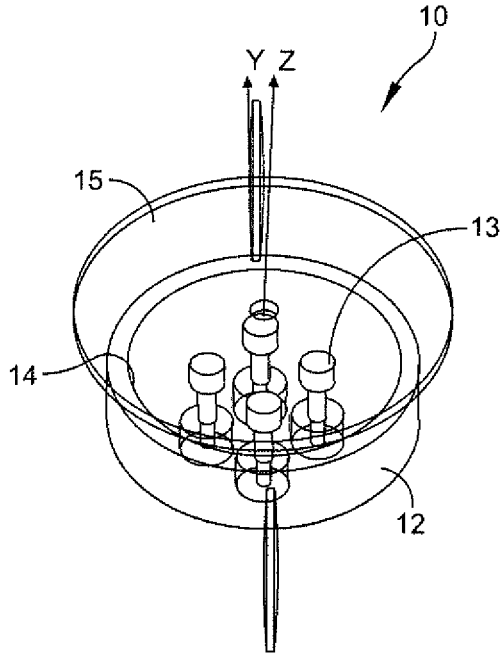
FIG. 1B (PRIOR ART)
FIG. 1B is a perspective view of the radiating element of FIG. 1A.

It is to be understood that the figures and descriptions of the present invention have been simplified to illustrate elements that are relevant for a clear understanding of the present invention, while eliminating, for purposes of clarity, many other features found in radar systems, including radiating elements of radar systems. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Embodiments of the present disclosure include low-cost, highly-integrated stacked radiating elements containing all the circuit layers needed to provide dual-pol performance over a large range of scan angles. More specifically, radiating elements according to embodiments of the present disclosure comprise a dielectrically-loaded circular waveguide capable of supporting both vertical and horizontal polarizations. This waveguide may be formed by a first plurality of vias arranged in a circular pattern in one or more layers (e.g. PWB layers) of dielectric material. The waveguide may be excited through a cross-slot aperture formed in a first groundplane by stripline feed traces embedded within another dielectric material layer for achieving two orthogonal polarizations. The stripline traces may be symmetrically arranged so as to excite respective first and second ends of first and second slots defining the cross-slot aperture. This even mode stripline feed arrangement replaces the feed probes and buried resistors of the Wilkinson dividers and combiners of the prior art. In one embodiment, a cavity may be defined in the dielectric layer by a second plurality of vias arranged around the stripline feed traces. A dielectric puck having the same dielectric constant as that of the feed layer and the waveguide layer may be arranged above the waveguide. Further, a rectangular, parasitically-coupled patch may be provided on the top surface of the dielectric puck.

Figure 2A:
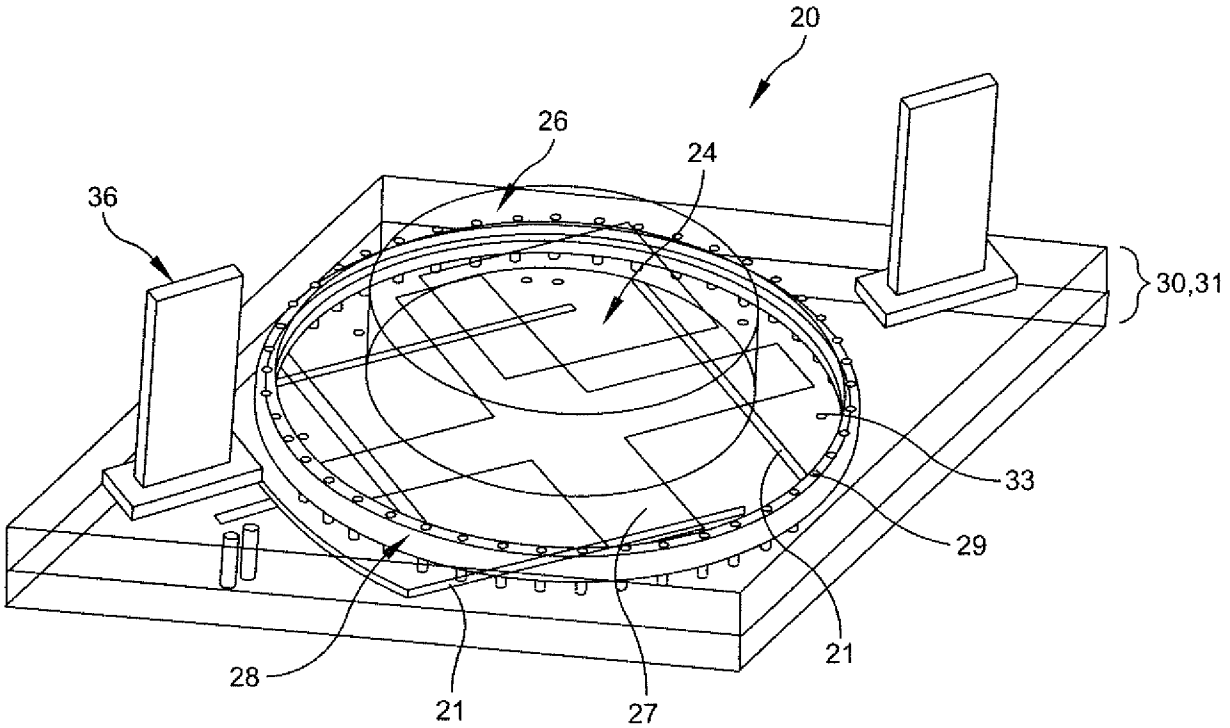
FIG. 2A is a perspective view of a radiating element according to an embodiment of the present disclosure.
Figure 2B:
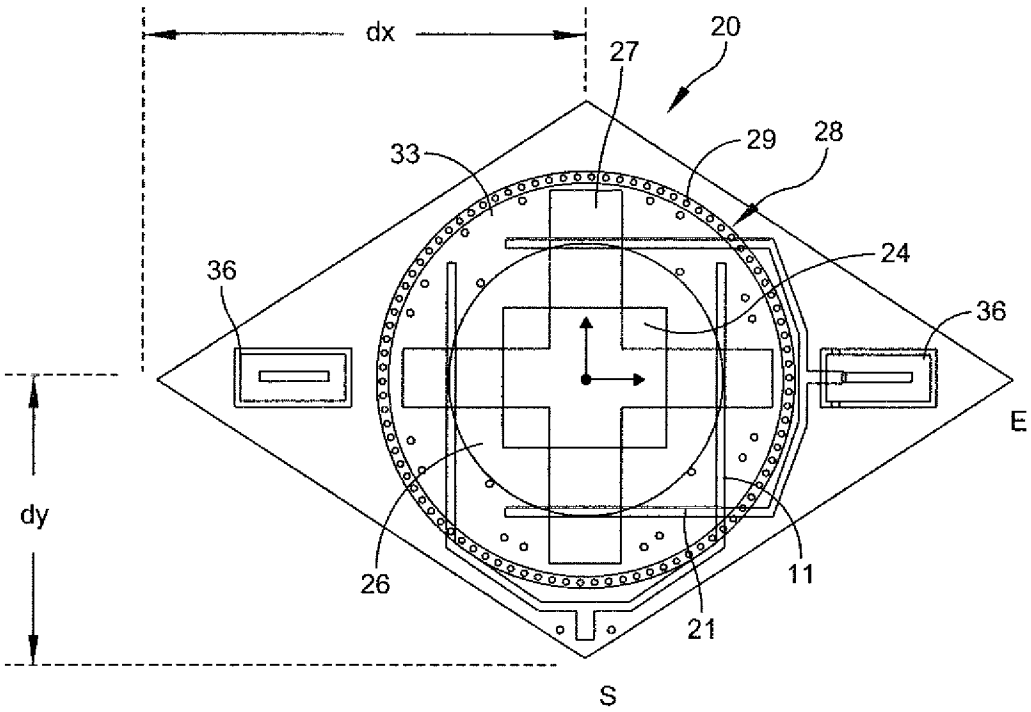
FIG. 2B is a top view of the radiating element of FIG. 2A.

Referring generally to FIGS. 2A and 2B, an exemplary embodiment of a radiating element 20 according to the present disclosure is illustrated. Radiating element 20 comprises a circular wave guide 28 configured to support both horizontal and vertical polarizations. In the exemplary embodiment, waveguide 28 comprises a plurality of metalized vias 29 arranged in a circular pattern through one or more layers of dielectric material (i.e. a dielectrically-loaded waveguide), such as one or more PWB layers 30. In one embodiment, the dielectric material may include a Polytetrafluoroethylene (PTFE) reinforced ceramic. Waveguide 28 is excited by feed elements embedded in another dielectric layer (or feed layer), such as PWB layers 31. In the exemplary embodiment, these feed elements comprise pairs of stripline traces 21 exciting waveguide 28 through a cross-slot aperture 27 formed in a first groundplane arranged between the waveguide and feed layers 30,31, allowing both horizontal and vertical polarizations to be excited in waveguide 28. More specifically, stripline traces 21 are configured to evenly excite the ends of each of the two slots defining aperture 27, thereby providing even mode excitation, which reduces cross-pol interference and improves bandwidth. Embodiments of the present disclosure may also include a cavity formed around stripline feed traces 21 by a second plurality of vias 33 to further increase the bandwidth of the element. More specifically, the cavity formed around the stripline feed traces enhances bandwidth performance by preventing any other propagating modes from interfering with the fundamental TEM (transverse electric and magnetic) stripline mode and efficiently coupling the RF energy to the cross slot apertures.

Still referring to FIGS. 2A and 2B, a dielectric resonator configured as dielectric puck 26 is arranged above waveguide 28 (e.g. coaxially) and acts as a lens for improving the wide-angle performance of radiating element 20 across all operating frequencies. In one embodiment, dielectric puck 26 comprises a material of the same dielectric constant as that of the dielectric layers containing waveguide 28 and stripline feed traces 21. The choice of the dielectric material depends on a variety of factors including electrical size, cost, weight, and coefficient of thermal expansion (CTE). In one embodiment, RO3003, a ceramic-reinforced PTFE material with a dielectric constant of 3, may be implemented, as it provides a suitable balance between cost, performance, CTE and electrical size. However, any dielectric constant can be used provided the material and trace losses are compliant with required performance.

Moreover, dielectric puck 26 may be similar in size to that of waveguide 28 arranged therebelow, so as to reduce the effective dielectric constant of this layer for better conjugate matching. A rectangular, parasitically-coupled patch 24 may be provided on a top surface of dielectric puck 26 to further enhance impedance matching. Patch 24 may take the form of, for example, an etched conductive (e.g. copper) rectangle. In the illustrated embodiment, metallic (e.g. aluminum) baffles or wings 36 may be provided and arranged on a surface of the element (e.g. a top surface of a first dielectric layer) in the long lattice dimension to reduce mutual coupling between neighboring elements populating an array, increasing element efficiency and enabling excellent wide angle performance.

More generally, wide angle impedance matching is accomplished with the aid of the dielectric puck, the parasitic patch, and the mutual coupling reduction wings. The dielectric puck serves as the mechanism to efficiently bend the incoming and outgoing electromagnetic wave at large scan angles. The parasitic patch together with the dielectric puck also provide conjugate matching in terms of transforming the free space impedance to the impedance of the stripline feed traces, thereby providing a well-matched condition for the electromagnetic wave.

In one embodiment of the present disclosure, each of the layers of the radiating elements described herein is fabricated out of the same dielectric material using known, cost-effective PWB processes. For example, as set forth above, one of more PWB layers may be used to create the above-described waveguide layer containing circular waveguide 28. A second one or more PWB layers may comprise the stripline feed layer, having striplines 21 embedded therein for exciting the cross-slot of a groundplane arranged between the feed layer and the waveguide layer. Further still, a dilation or routing layer is provided to take signals from one location to another for the purpose of interconnection. A microstrip layer for mounting components, such as a circulator and power connections may also be provided as part of the layered PWB stack. This configuration provides for a highly integrated structure which eliminates the labor-intensive features of arrangements of the prior art, as well as the need for often complex thermal management provisions.

Figure 3:
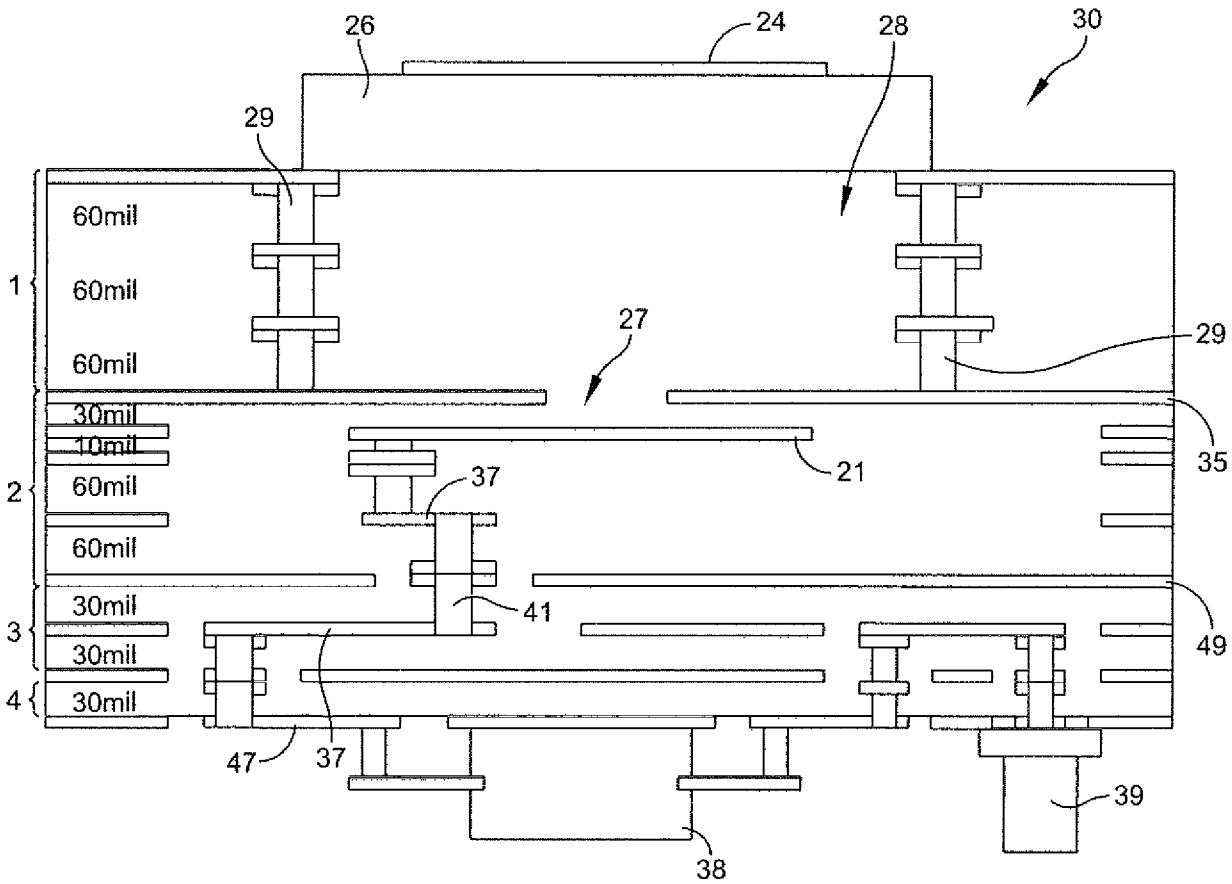
FIG. 3 is a cross-sectional view of a radiating element according to an embodiment of the present disclosure.

An exemplary cross-sectional view of an embodiment of a radiating element utilizing this stacked PWB construction is illustrated in more detail in FIG. 3. Similar to the arrangements of FIGS. 2A-2B, radiating element 30 may comprise a dielectric puck 26 and an associated parasitically-coupled patch 24 arranged over a first or waveguide PWB layer 1. This waveguide layer includes the above-described circular waveguide 28 formed from a plurality of vias 29 arranged in a circular pattern. In the illustrated embodiment, layer 1 comprises of a plurality (e.g. 3) of PWB sub-layers, each sub-layer having a plurality of circularly-arranged vias 29 formed therein, each via operatively connected to a corresponding via formed in an adjacent sub-layer, for forming waveguide 28. While a representative three sub-layer construction is shown, it should be understood that any number of PWB or dielectric layers may be used to form circular waveguide 28 without departing from the scope of the present disclosure.

Still referring to FIG. 3, element 30 may comprise a first groundplane 35 arranged between waveguide layer 1 and a feed layer 2 having cross-slot aperture 27 formed therein. As described above, aperture 27 is excited by, for example, two embedded stripline feed traces 21 formed in feed layer 2, and arranged beneath slot 27. Like waveguide layer 1, feed layer 2 may comprise several dielectric PWB sub-layers, including additional stripline feed traces 37 and associated metalized transitions or vias 41 for providing signal to stripline feed traces 21. A dilation layer 3 may be provided beneath a second groundplane 49, and between feed layer 2 and a microstrip layer 4. Array electronics, such as a circulator 38 and a power/signal connection port(s) 39 may be arranged on an exposed surface of microstrip layer 4, and operatively connected to stripline feed traces 21 by microstrip traces 47 formed on microstrip layer 4, as well as additional stripline traces 37 and transitional vias 41 arranged in dilation layer 3 and feed layer 2, as exemplarily illustrated.

Referring to Table 1 (below), in conjunction with FIG. 2B, a particularly advantageous configuration of a radiating element according to an embodiment of the present disclosure comprises the following dimensions given in terms of operating wavelength:

TABLE 1

| Element Information | |
|---|---|
| Lattice | Triangular |
| Spacing (wavelength) | dx = 0.5113<br>dy = 0.3319 |
| Component | Value (Wavelength) |
| Puck | |
| Thickness | 0.101 |
| Radius | 0.162 |
| Er | 3 |
| Parasitic Patch | |
| Length | 0.196 |
| Width | 0.168 |
| Wing | |
| Thickness | 0.014 |
| Height | 0.279 |
| Width | 0.084 |
| Waveguide | |
| Thickness | 0.050 |
| Radius | 0.243 |

TABLE 1-continued

| Element Information | |
|---|---|
| Er | 3 |
| Feed Layer | |
| Thickness | 0.045 |
| EW Feed Offset | 0.008 |
| NS Feed Offset | 0.011 |
| EW Slot Length | 0.441 |
| EW Slot Width | 0.070 |
| NS Slot Length | 0.441 |
| NS Slot Width | 0.084 |

Figure 4A:
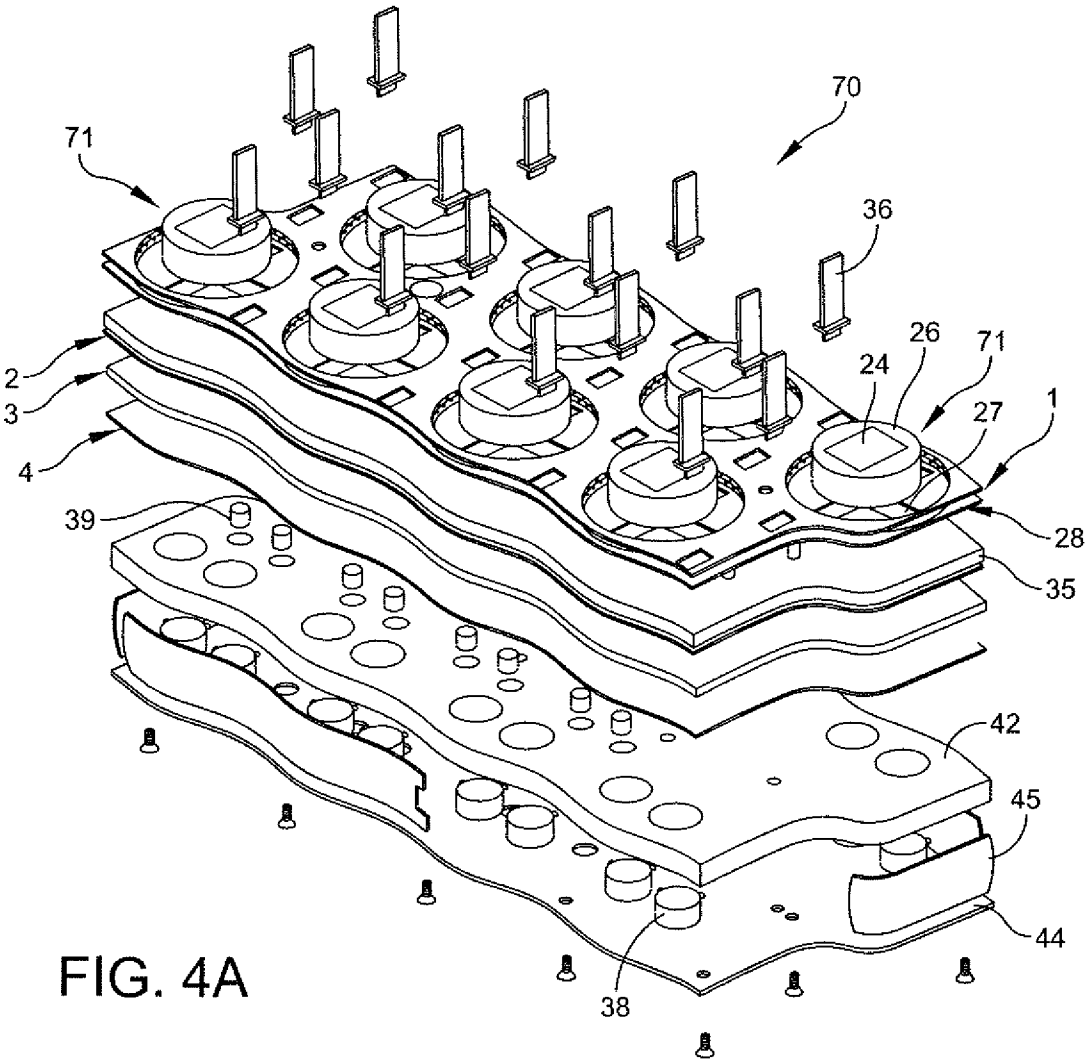
FIG. 4A is an exploded perspective view of an array of radiating elements according to an embodiment of the present disclosure.
Figure 4B:
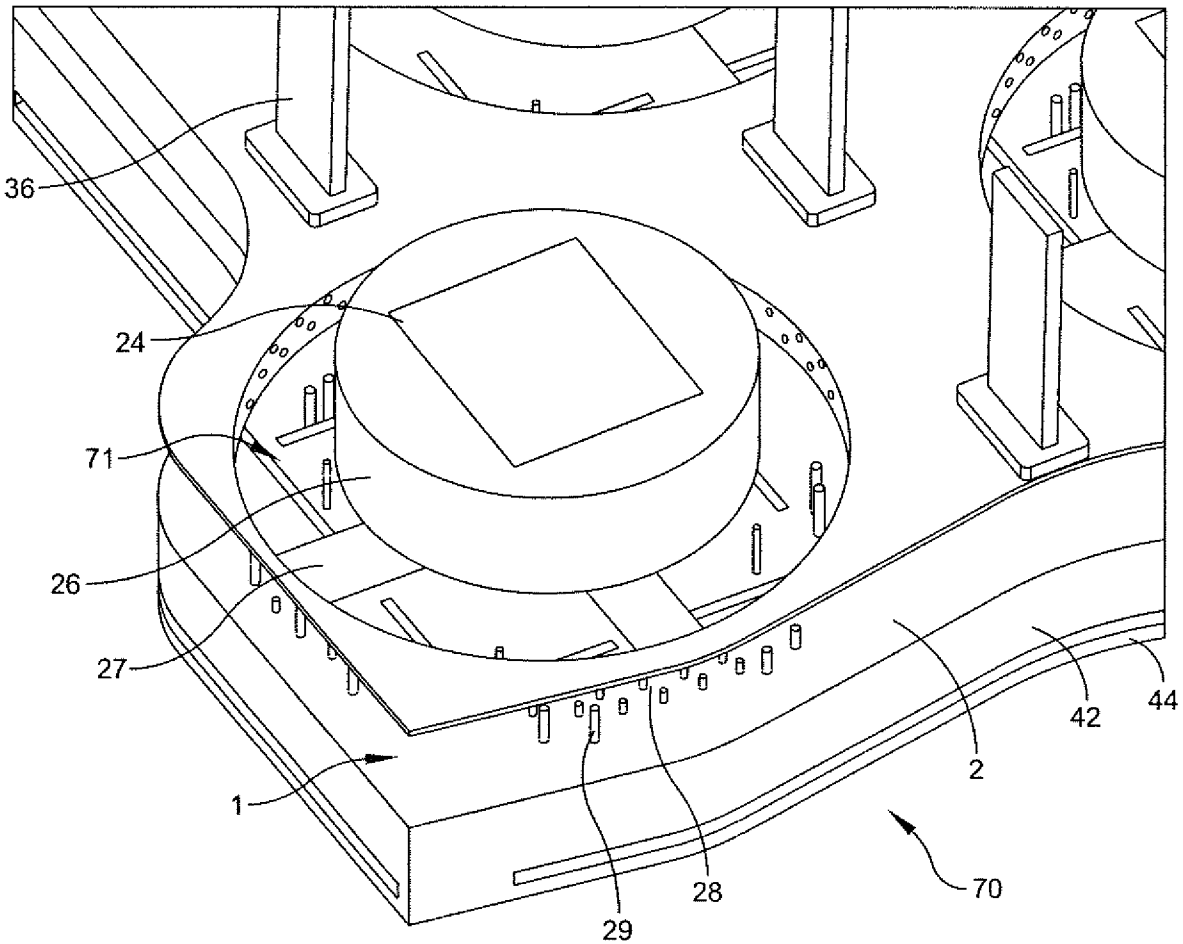
FIG. 4B is a partial perspective view of an assembled radiating element according to the embodiment of FIG. 4A.

FIGS. 4A and 4B illustrate an exemplary packaging assembly for radiating elements according to embodiments of the present disclosure. Specifically, FIG. 4A is an exploded view of an exemplary antenna array tile 70, including eight (8) radiating elements 71 arranged therein. As set forth above with respect to the previous embodiments of the present disclosure, each element 71 may include a parasitic patch 24 (e.g. an etched copper patch) arranged over a dielectric puck 26. Puck 26 may be oriented generally over a corresponding circular waveguide 28 formed in a first PWB or waveguide layer 1 by a plurality of metalized vias 29 (FIG. 4B). Also arranged on waveguide layer 1 may be a plurality of metallic wings 36. As illustrated, a plurality of apertures may be formed on a top surface of waveguide layer 1, and configured to accept a portion of each of wings 36. Wings 36 may be secured within these apertures by any suitable method, including adhesives (e.g. epoxy).

A groundplane 35 defining cross-slot aperture 27 is arranged between waveguide layer 1 and a feed layer 2, which includes the above-described stripline feeds for balanced excitation of each of the slots of cross-slot aperture 27. A dilation layer 3, as well as a microstrip layer 4 may also be provided, wherein element control components, such as circulators 38 and power/signal ports 39 may be arranged on an exposed surface of microstrip layer 4.

An aluminum base plate 42 may form the support structure for tile 70. As illustrated, base plate 42 may comprise a plurality of apertures for receiving, for example, circulators 38 and ports 39, once installed on microstrip layer 4. A cover 44 may also be provided, and configured to be removably attached to base plate 42 via, for example, fasteners, allowing for ease of access to the elements' electronic components. In the exemplary embodiment, an EMI gasket 45 is also provided, and attached to an outer perimeter of cover 44 such that, when installed, gasket 45 provides improved tile-to-tile shielding of the electronic components against external EMI sources.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A radiating element for a radar array antenna comprising:

a first dielectric material layer having a circular waveguide formed therein;

a dielectric resonator arranged over the circular waveguide;

a parasitic patch arranged over the dielectric resonator;

a second dielectric material layer arranged below the first dielectric material layer;

a cross-slot aperture formed in a groundplane arranged between the first and second dielectric material layers;

a first feed element formed in the second dielectric material layer, the first feed element having a first portion arranged at a first distance from a first end of a first slot of the cross-slot aperture, and a second portion arranged at a distance from a second end of the first slot of the cross-slot aperture equal to said first distance for achieving even mode excitation of the first slot; and a second feed element formed in the second dielectric material layer, the second feed element having a first portion arranged at a second distance from a first end of a second slot of the cross-slot aperture, and a second portion arranged at a distance from a second end of the second slot of the cross-slot aperture equal to said second distance for achieving even mode excitation of the second slot.

2. The radiating element of claim 1, wherein the dielectric resonator is configured as a dielectric puck.

3. The radiating element of claim 1, wherein the dielectric resonator and the second dielectric material layer comprise the same dielectric constant.

4. The radiating element of claim 1, wherein the circular waveguide comprises a plurality of vias formed in the first dielectric material layer in a generally circular pattern.

5. The radiating element of claim 1, wherein the first and second feed elements comprise first and second stripline traces embedded in the second dielectric material layer.

6. The radiating element of claim 1, further comprising first and second metallic baffles arranged on a top surface of the first dielectric material layer.

7. The radiating element of claim 1, further comprising a circulator arranged on a third dielectric material layer.

8. The radiating element of claim 7, wherein the circulator is operatively connected to microstrip traces formed on a surface of the third dielectric material layer.

9. The radiating element of claim 7, further comprising at least one of a power and signal port arranged on the third dielectric material layer.

10. The radiating element of claim 7, further comprising a fourth dielectric material layer comprising a dilation layer arranged between the second dielectric material layer and the third dielectric material layer.

11. The radiating element of claim 1, wherein a cavity defined by a plurality of vias is formed around the feed element in the second dielectric material layer.

12. The radiating element of claim 1, wherein the first and second dielectric material layers comprise printed wire board layers.

13. A radar antenna array having a plurality of radiating elements, the array comprising:

a first dielectric material layer having a plurality of circular waveguides formed therein;

a plurality of dielectric resonators, each of the plurality of dielectric resonators arranged over a respective one of the plurality of circular waveguides;

a plurality a parasitic patches, each of the plurality of parasitic patches arranged over a respective one of the plurality of dielectric resonators;

a second dielectric material layer arranged below the first dielectric material layer;

a groundplane arranged between the first dielectric material layer and the second dielectric material layer, the groundplane defining a plurality of cross-slot apertures, each aperture associated with a respective one of the plurality of circular waveguides;

a plurality of feed elements, each of the plurality of feed elements associated with a respective one of the plurality of cross-slot apertures and comprising:

a first feed element formed in the second dielectric material layer, the first feed element having a first portion arranged at a first distance from a first end of a first slot of the respective cross-slot aperture, and a second portion arranged at a distance from a second end of the first slot of the respective cross-slot aperture equal to said first distance for achieving even mode excitation of the first slot; and a second feed element formed in the second dielectric material layer, the second feed element having a first portion arranged at a second distance from a first end of a second slot of the respective cross-slot aperture, and a second portion arranged at a distance from a second end of the second slot of the respective cross-slot aperture equal to said second distance for achieving even mode excitation of the second slot.

14. The antenna array of claim 13, wherein each of the plurality of dielectric resonators is configured as a puck.

15. The antenna array of claim 13, wherein each of the first and second feed elements comprise first and second stripline traces.

16. The antenna array of claim 13, wherein each of the plurality of circular waveguides comprises a plurality of vias formed in the first dielectric material layer in a generally circular pattern.

17. The antenna array of claim 13, further comprising a metallic base plate arranged below the first and second dielectric material layers.

18. The antenna array of claim 17, further comprising a cover removably attached to a side of the metallic base plate.

19. The antenna array of claim 13, wherein the first and second dielectric material layers comprise printed wire board layers.

20. The antenna array of claim 13, further comprising a plurality of metallic baffles, each of the baffles arranged on a top surface of the first dielectric material layer generally between the plurality of circular waveguides.

* * * * *